United States Patent [19]

Daniels

[11] Patent Number: 4,586,204

[45] Date of Patent: May 6, 1986

[54] RECIRCULATING BATHTUB

[76] Inventor: Phillip D. Daniels, 4797 Lake Bluff, West Bloomfield Township, Oakland County, Mich. 38033

[21] Appl. No.: 653,595

[22] Filed: Sep. 24, 1984

[51] Int. Cl.[4] ..... A61H 33/02

[52] U.S. Cl. ..... 4/542; 4/544; 239/550; 239/600

[58] Field of Search ..... 4/541-544; 128/66; 239/428.5, 550, 600; 137/888; 138/111, 115

[56] References Cited

U.S. PATENT DOCUMENTS

| | | | |
|---|---|---|---|
| 3,391,870 | 7/1968 | Nash . | |
| 3,396,722 | 8/1968 | Lindberg . | |
| 3,472,025 | 10/1969 | Simmons et al. | 239/550 |
| 3,890,655 | 6/1975 | Mathis | 4/178 |
| 3,890,656 | 6/1975 | Mathis | 4/542 |
| 3,907,002 | 9/1975 | Gülich | 138/115 |
| 3,946,449 | 3/1976 | Mathis | 4/178 |
| 4,225,984 | 10/1980 | Lindsey | 128/66 |
| 4,240,166 | 12/1980 | Altman et al. | 4/542 |
| 4,262,371 | 4/1981 | Berry et al. | 4/191 |
| 4,264,039 | 4/1981 | Moreland . | |
| 4,290,154 | 9/1981 | Benjamin | 4/538 |
| 4,320,541 | 3/1982 | Neenan | 4/542 |
| 4,335,854 | 6/1982 | Reynoso . | |
| 4,339,833 | 7/1982 | Mandell | 4/542 |
| 4,340,039 | 7/1982 | Hibbard et al. | 128/66 |
| 4,340,982 | 7/1982 | Hart et al. | 4/492 |
| 4,349,923 | 9/1982 | Chalberg | 4/542 |
| 4,358,862 | 11/1982 | Altman et al. | 4/542 |
| 4,379,097 | 4/1983 | Leggett | 261/78 |
| 4,416,030 | 11/1983 | Reynoso | 4/542 |
| 4,420,846 | 12/1983 | Bonner | 4/542 |
| 4,422,191 | 12/1983 | Jaworski | 4/496 |

*Primary Examiner*—Stephen Marcus
*Assistant Examiner*—Linda J. Sholl
*Attorney, Agent, or Firm*—Hiram P. Settle

[57] ABSTRACT

A recirculating bathtub having a single manifold extending along each side of the tub to supply water from a pump and aspirated air to a plurality of tub inlets. Each manifold comprises integrally molded, preferably blow-molded, air and water conduits isolated from one another except at nozzle housings integrally formed in the water conduit and vented to the air conduit. A nozzle is positioned in each housing and is sealed in the housing to receive water from the water conduit and air from the air conduit. The integrally formed conduits and nozzle housings eliminate the need for clamped or welded joints, and it is unnecessary to drill or open the manifolds for nozzle installation or air passage. The pump and the manifolds are self-draining into the tub when the tub is emptied.

13 Claims, 11 Drawing Figures

FIG. 1
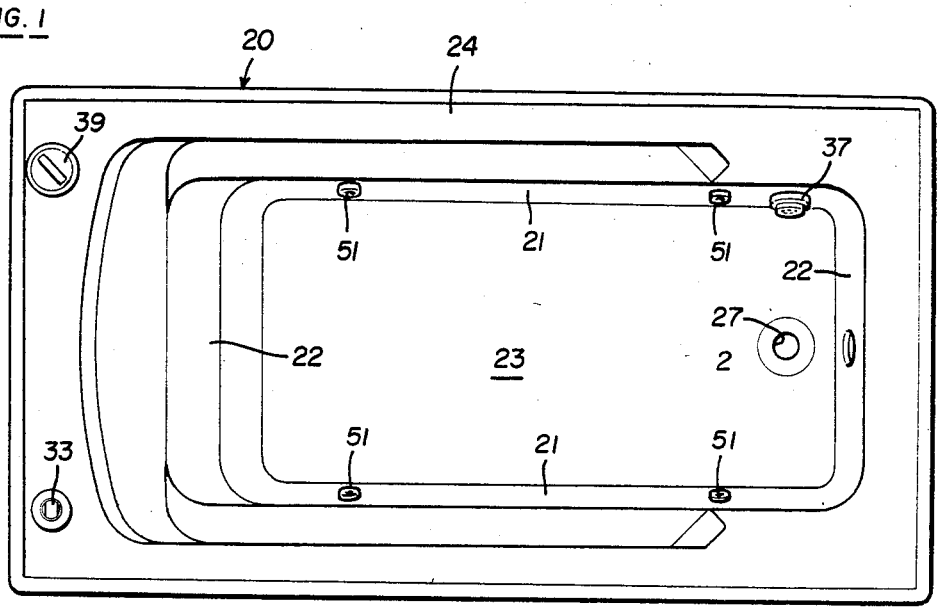
FIG. 2
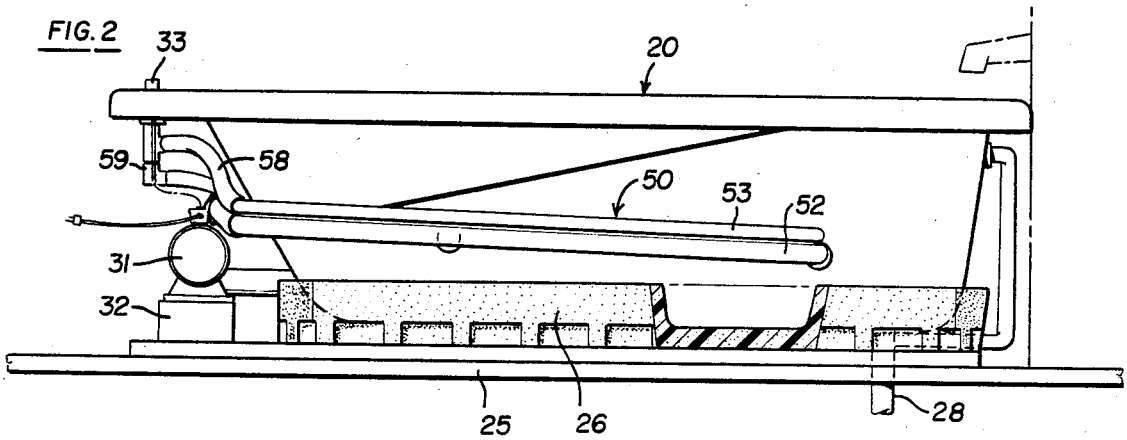
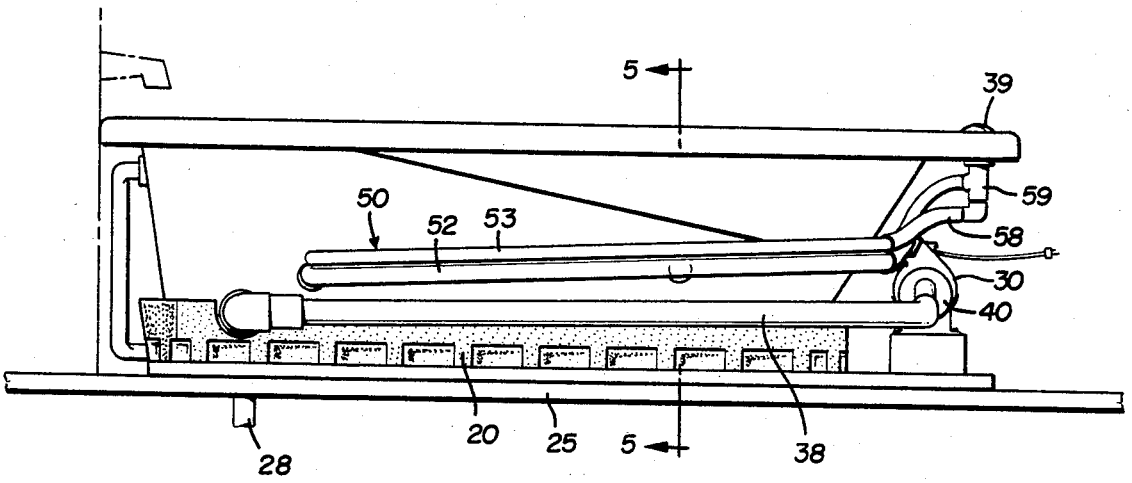
FIG. 3

FIG. 4
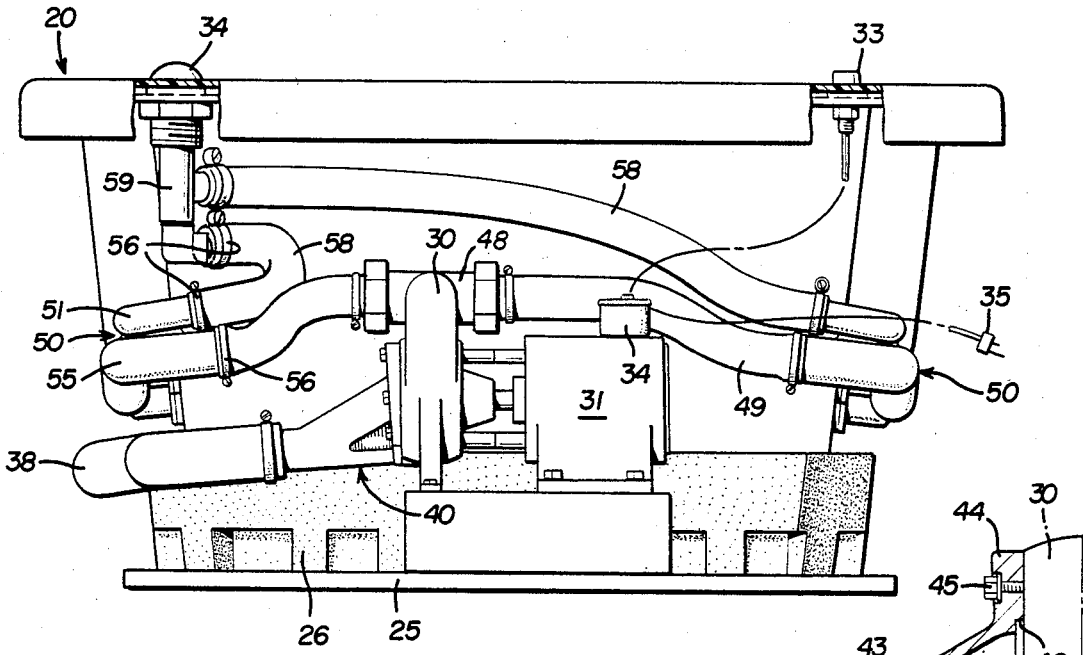
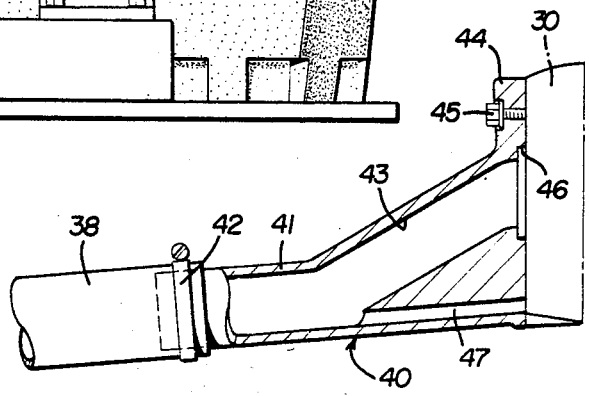
FIG. 5
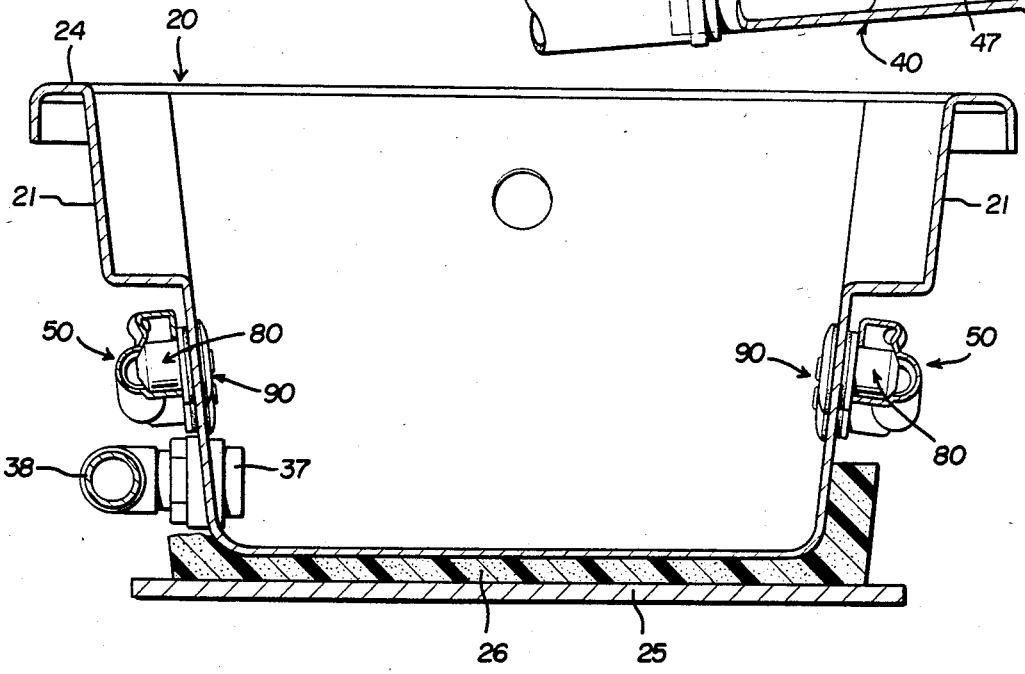
FIG. 6

RECIRCULATING BATHTUB

BACKGROUND OF THE INVENTION

In recent years, the use of recirculatory bathtubs of the "spa" or "Jacuzzi" type have become popular for individual homes. Such tubs utilize a circulatory water pump to recirculate water from the tub through a water flow line to air aspirating nozzles located in the tub side walls.

In order to circulate the water and to induce air flow into each nozzle, the fluid flow lines normally are fabricated from plastic pipe sections of various sizes which are solvent-welded into an assembly running from the pump along each tube side wall. To completely fabricate the assembly of water conduit, air conduit, water inlet line, air inlet line, and nozzle connections, as many as 22 solvent welds are required on either side of the tub for a tub equipped with only four nozzles. The cost and the requisite fabrication time, as well as the possibility of leakage at any one of the solvent-welded joints can readily be appreciated.

Various proposals for utilizing combination air and water fittings to reduce the cost and time of fabrication have been made. For example, U.S. Pat. Nos. 3,890,656, 3,946,449, and 4,416,030 have proposed the use of various types of plastic injection molded "T" fittings for insertion into the water and air lines. Separate welds are still required to attach each of the fluid supply lines to each fitting, and a minimum of four welds are still required for each nozzle, plus welds to close any other openings for drilling fluid entry ports. The possibility of multiple leakage points at each of the nozzle locations still exists.

A different proposal is made in U.S. Pat. Nos. 4,240,166 and 2,358,862. Here, a single piece of internally partitioned pipe is wrapped around the tub, and the pipe is drilled at several locations to provide access to the interior water and air passages. A nozzle is then clamped to the pipe and the mixed water and air is conveyed to the tub inlet located remotely from the nozzle, The assembly of the fluid passages is somewhat simplified, but clamping of the nozzles to the composite pipe externally of the pipe can still cause leakage problems. Further, substantial manual labor is still required for bending the pipe around the tub and assembling the nozzles and conduits for the mixed water and air to the tub inlet ports.

Further, the design of the prior art tubs is such that water in the water distribution system will not drain after the pump is shut off. As a result, stagnant water is trapped in the water lines, the pump and the nozzles, so that algae and other growths from organic material in the stagnant water may occur. When the system is next started, this stagnant water enters the tub and contacts the occupant of the tub, possibly causing skin rashes, eye irritation, and the like.

Thus, it will be seen that the prior art recirculating bathtub systems suffer from serious defects. None of the prior art effectively provides a fluid flow system free of leakage at the location of the nozzles. Where the bathtub is installed in an alcove in which only one side of the tub is accessible or in an island, which may be carpeted below the tub level completely around the tub, any leakage causes severe repair problems which are difficult to resolve. Further, none of the prior art discloses any means for effectively draining the water circulatory system to eliminate the health hazards from stagnant water laying in the system for extended periods of time.

BRIEF DESCRIPTION OF THE INVENTION

The present invention proposes a recirculating bathtub utilizing a single manifold on each side of the tub and including integrally formed or joined water and air conduits. The conduits each communicate with integrally formed nozzle housings each adapted to receive a nozzle assembly. No separate air or water joints or welded connections are required for the joining of separate fluid conduits to individual nozzle enclosures, as in the prior art. Further, no drilling or other opening of the manifold is necessary for nozzle installation, and each manifold serves at least two nozzles locations without any solvent-welded or clamped joints. The nozzle housings integrally formed with the manifold receive individual nozzles assemblies which are sealed in the housings to receive both water and air from the respective conduits.

The manifolds on each side of the tub drain back into the tub when the pump is shut off, and drain openings are provided in each nozzle assembly to permit the drainage of substantially all of the water from the associated manifold and nozzle assemblies. Further, the pump drains into the tube through the pump inlet line once the pump is shut off.

Thus, it will be seen that the present invention remedies several of the defects of recirculating bathtubs of the type heretofore known and utilized. Specifically, the present invention minimizes the number of clamped or welded joints necessary to the provision of the water and air circulatory system to minimize the possibility of leakage from such joints or welds and to simplify and reduce the cost of manufacturing recirculatory bathtubs. Further, the present invention virtually eliminates stagnant water within the circulatory system by substantially completely draining the circulatory system once the pump is shut off. This materially reduces the health hazards inherent in the utilization of such recirculatory bathtubs.

BRIEF DESCRIPTION OF THE DRAWINGS

FIG. 1 is a plan view of a recirculating bathtub of the present invention.

FIG. 2 is a side elevational view of one side of the bathtub of FIG. 1.

FIG. 3 is a side elevational view of the other side of the bathtub of FIG. 1.

FIG. 4 is an end view of the bathtub of FIG. 1.

FIG. 5 is a sectional view taken along the plane 5—5 of FIG. 3.

FIG. 6 is a fragmentary sectional view, with parts shown in elevation, of the pump intake manifold.

DESCRIPTION OF THE PREFERRED EMBODIMENT

Figure 8:
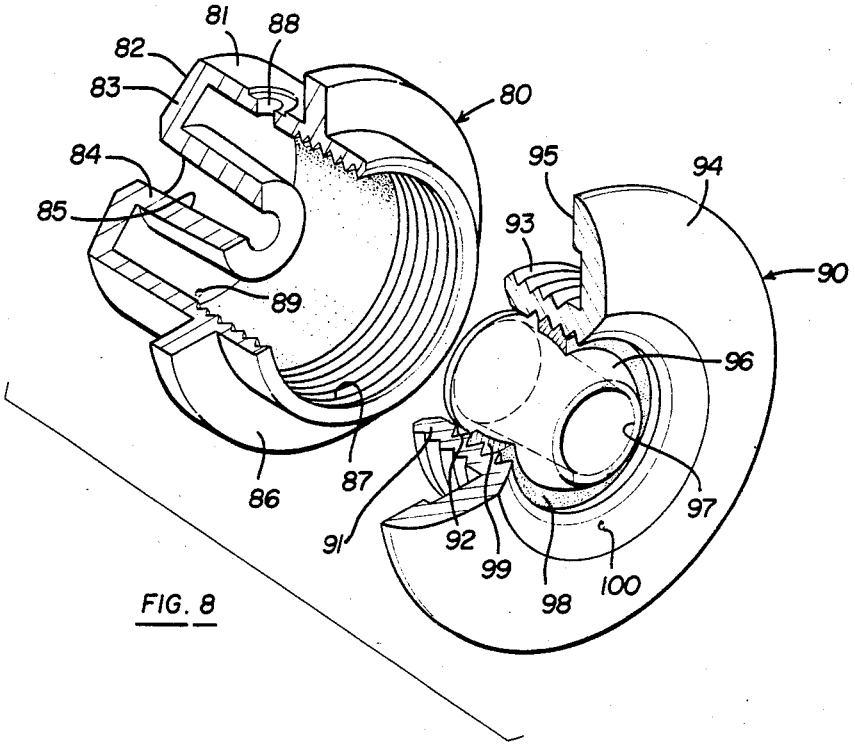
FIG. 8 is a perspective exposed view of a nozzle assembly of the bathtub of the present invention.

As shown in FIGS. 1 through 5 of the drawings, reference numeral 20 refers to a bathtub of the present invention including side walls 21 and end walls 22 enclosing an open-topped interior space 23 surrounded by an outturned flange 24. The tub is mounted on a bottom support member or base 25 which may be a sheet of plywood or chipboard, and the bottom wall of the tub, the lower regions of the side walls 21 and the end walls 22, is encased in a molded, foamed plastic support 26. The support 26 is interposed between the bottom wall of the tub and the lower support 25 to prevent "oil-canning" of the tub due to the weight of the water in the tub and of an occupant in the tub.

The tub bottom wall is provided with a conventional drain opening 27 communicating with a lower drain pipe 28 in the conventional manner.

The recirculatory system for the tub 20 includes a centrifugal water pump 30 driven by a motor 31 mounted in an elevated position above the base 25 on a stand 32 to facilitate drainage of the pump when the pump is shut off. The motor is controlled by an off-on switch 33 mounted on the flange 24 of the bathtub, this switch preferably being of the conventional pneumatic, push-type switch communicating with a switchbox 34 mounted atop the pump 31 and also serving to connect the pump through leadline 35 with a source of electrical energy.

Located in one of the tub side walls 21 close to the tub drain 27 is a tub outlet opening 37 communicating through a water conduit 38 with the intake of the pump 30 through a pump intake manifold 40, best illustrated in FIG. 6 of the drawings. This pump intake manifold 40 preferably is injection-molded or vacuum-formed from a suitable thermoplastic material and includes a tubular end portion 41 connected to the water conduit 38 by suitable means, as by a clamp fitting 42. The tubular end portion 41 is located below the level of the pump intake opening and communicates with the pump intake opening by an integral, upwardly inclined tubular inlet passage 43 terminating in a mounting flange 44 secured to the end face of the pump by suitable means, as by bolts 45, so that the included tubular passage 43 opens directly onto the axial pump intake opening (not shown). Preferably, the mounting flange 44 is sealed to the pump intake face by suitable means, such as by an O-ring 46. A lower drain opening 47 communicates with the interior of the pump at the lowermost extremity thereof to accommodate the flow of liquid from the pump and to drain the pump housing when the pump is shut off. Of course, during operation of the pump and the pumping of liquid through the pump housing, some of the liquid being pumped will discharge through the drain opening 47. However, the drain opening 47 is quite small, e.g., on the order of ⅛" in diameter, and a negligible amount of water will be discharged under pressure through the opening 47 to be recirlated back to the pump inlet through the much larger pump inlet passage 43.

Figures 9, 10, 11:
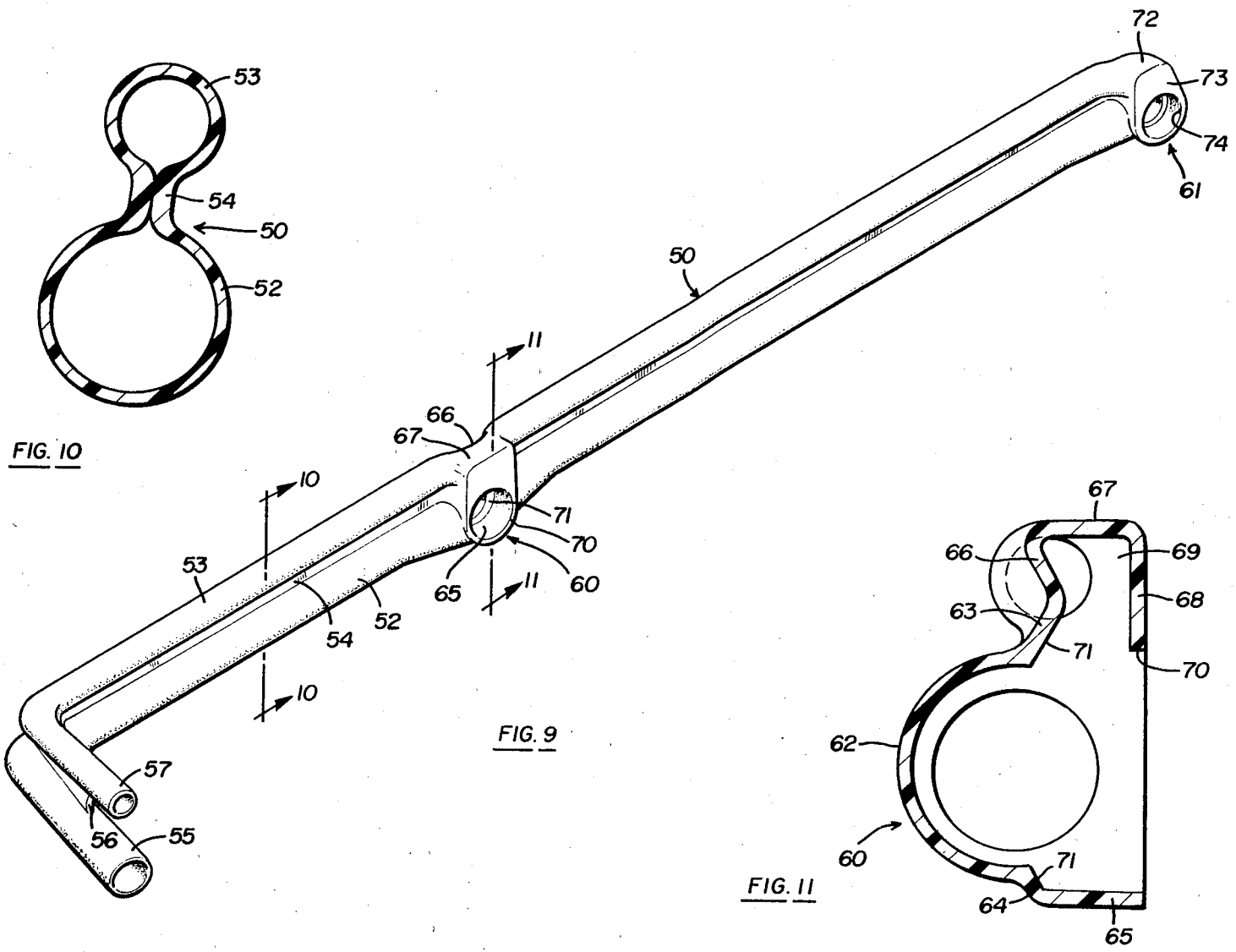
FIG. 9 is an elevational perspective view of a water and air manifold of the bathtub of the present invention.
FIG. 10 is an enlarged sectional view taken along the plane 10—10 of FIG. 9.
FIG. 11 is an enlarged sectional view taken along the plane 11—11 of FIG. 9.

The pump 30 discharges through a "T" fitting 48 and flexible hoses 49 into a pair of water and air manifolds indicated generally by the reference numeral 50 and extending along either side of the bathtub to bridge a plurality of water and air discharge openings 51 located in the tub side walls 21. The manifolds 50 are illustrated in detail in FIGS. 9 through 11 of the drawings, from which it will be seen that each manifold 50 includes a lower water conduit 52, an upper air conduit 53 and an intermediate, integrally formed joining portion 54, as best seen in FIG. 10 of the drawings. Preferably, the manifolds 50 are formed of a thermoplastic resin, such as ADS, polyethylene, polypropylene or the like, and preferably the manifolds are blow-molded from a single piece of thermoplastic tubing. During the blow-molding process, an initial, large tubular parison is pinched shut to form the double-walled intermediate portion 54 intermediate the two blown conduits 52, 53.

From FIG. 9, it will be seen that each manifold 50 includes a linear elongated portion extending alongside the tub side walls and of a length to bridge the distance from one tub end to each of the inlet openings 51 formed in the tub side walls and a relatively shorter angularly related end portions 55, 57 which extend along the tub end wall. The end portion 55 of the water conduit terminates in proximity to the pump and is connected to the pump by means of the flexible tubing 49 and the "T" fitting 48. Appropriate clamps 56 are utilized to interconnect the tubing 49 with the water conduit 52. The end portion 57 of each upper air conduit 53 is connected by flexible tubing 58 and clamps 56 to an upper air conduit 59 communicating with an air control valve 39 exposed for user manipulation at the flange 24 of the tub 20, as shown in FIGS. 1 and 4. The control 39 is of conventional type and controls the opening by which ambient air is aspirated into the conduit 59.

As will be seen from FIG. 9, the conduits 52 and 53 are coextensive, as is the intermediate portion 54, the intermediate portion terminating short of the free ends of the conduits, as at 56, to facilitate the attachment of the flexible hoses 49, 58.

Preferably, the manifold 50 is blow-molded in its entirety, although the manifold may be injection-molded as a unitary assembly or it may be extruded as individual components which are then solvent-welded into an integral unit, if desired.

As blow-molded, the manifold is provided with integrally formed, blown nozzle assembly housings 60, 61 which are spaced along the length of the manifold at the spacing of the tub water entry ports 51. The housing 60 is best illustrated in FIG. 11 of the drawings, from which it will be seen that the housing is defined by a bulbous, enlarged, integral wall 62 of substantially larger radius than the water conduit portion 52. The wall 62 is generally semispherical in contour and is joined at its lateral edges to the conduit 52 through annular frustro-conical wall segments which form continuations of the upper arcuate wall 63 and the lower arcuate wall 64 shown in FIG. 11.

The lower wall 64 merges into a partial cyclindrical bottom wall 65, and the upper wall 63 merges into an offset portion 66 of the air conduit 53 which is localized over the housing 60 and which is formed during blow-molding. This offset portion 66 is surmounted by a planar forward extension 67 which terminates in a down-turned vertical planar end wall 68 also formed during blow-molding. The walls 63, 66, 67 and 68 cooperate to define an air chamber 69 which overlies the bulbous housing 60 and communicates therewith through the open bottom of the chamber. The air chamber 69 opens laterally onto the air conduit 53. The vertical wall 68 is aligned with the outer extremity of the lower wall 65, and the wall is apertured, as at 70, to provide access to the housing 61, the opening 70 either being formed during blow-molding or being later cut in the wall 68.

The end housing 61 is substantially the same as the housing 60, above described, except that the housing 61 is located at the terminal end of the conduits 52, 53. The water conduit 52 again is provided with the bulbous housing 62, the water conduit communicates fully with the bulbous housing, and the air conduit 53 is laterally offset, as at 71, to overlie the housing, and a planar end face 73 is provided, this end face 73 being apertures, as at 74, to provide access to the housing.

Figure 7:
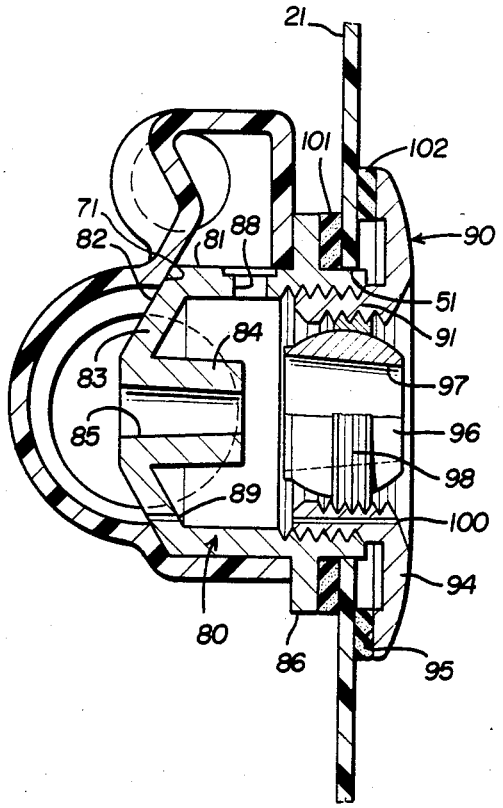
FIG. 7 is an enlarged vertical section, with parts shown in elevation, of a nozzle assembly inserted into the water and air manifold of the tub of FIG. 1.

In FIGS. 7 and 8, a nozzle assembly adapted for insertion into the housings 60, 61 and for attachment to the bathtub side wall at each of the tub inlet locations 51 is illustrated. This nozzle assembly 80 is insertable into one of the housings 60, 61, the nozzle assemblies for the two housings being identical and being identically installed therein, as hereafter described.

Specifically, the nozzle assembly 80 includes a nozzle body 81 which is generally cylindrical in exterior configuration, having a rearwardly facing, inclined annular sealing face 82 formed by the rear surface of a rear closure wall 83. The closure wall 83 is provided with an integral, internal, axially-extending boss 84 having an internal, tapered water flow passage 85. The nozzle body 81 is provided with a radially outwardly extending mounting flange 86 located medially of the axial extent of the body 81, and the forward cylindrical extremity of the nozzle body 81 is internally threaded, as at 87. The exterior diameter of the threaded end portion of the nozzle body 81 is of substantially the same diameter as the aperture 70 in each of the nozzle housings 60, 61, and the inclined rear face 82 of the body 81 is of a diameter and inclination such that it matingly contacts the annular, inclined sealing surfaces 71 provided by the walls 63, 64 of each housing 60, 61. The nozzle body is provided with a radial aperture 88 establishing communication between the exterior of the nozzle body 81 and the space between the interior surface of the nozzle body 81 and the exterior surface of the embossment 84. A small diameter drain aperture 89 pierces the rear wall 82 of the nozzle body 81, the drain opening 89 being diametrically opposed to the aperture 88.

The nozzle assembly 80 also includes a mounting flange 90 comprising a body portion 91 which is both internally and externally threaded, as at 92, 93, respectively, the diameter of the body portion 91 being such that the threads 93 are threadedly received by the threads 87 of the nozzle body 81. The mounting flange also includes a radially enlarged flange 94 having a peripheral, annular, rearwardly projecting mounting face 95.

Positioned within the threaded axial opening in the body portion 91 of the mounting flange 90 is a spherical nozzle insert 96 having an axial, tapered bore 97 therethrough. A mounting ring 98 having external threads 99 is threaded into the internal threads 92 of the mounting flange body portion 91. The mounting ring 98 has an internal diameter which is less than the external diameter of the spherical nozzle insert 96, so it retains the insert in position against axial displacement outwardly from the remainder of the nozzle assembly.

As best illustrated in FIG. 7 of the drawings, each nozzle assembly 80 is inserted into one of the manifold housings 60, 61 with the inclined rear surface 82 of the nozzle body 81 contacting the inclined surfaces 71 of the nozzle housing and with the rear surface of the flange 86 contacting the forward extremity of the nozzle housing, as best illustrated in FIG. 7 of the drawings. Once the nozzle body 81 has been so inserted, it is preferably spin-welded to weld the surfaces 70. 82 into full, peripheral, sealing contact and similarly to weld and seal the flange 86 to the exposed forward surface of the nozzle assembly housing. The spin-welding is terminated with the aperture 88 registering with the water chamber 64 and with the drain opening 89 of the nozzle body 81 at the bottom of the housing, all as illustrated in FIG. 7 of the drawings. Alternatively, the nozzle assembly can be solvent-welded to the manifold 50.

Preferably, the nozzle assembly is so secured and sealed in each of the housings 60, 61 prior to assembly of the manifold, bearing the nozzle assemblies, upon the bathtub. Such assembly is accomplished by inserting the free forward end of each nozzle housing 81 from the tub exterior into the bathtub apertures 51 with an annular sealing gasket 101 interposed beween the wall 68 and the nozzle body flange 86, as illustrated in FIG. 7. Next, the mounting flange 90, with the nozzle insert 96 and the ring 98 preassembled therein, is inserted into the nozzle body 81 from the inside of the bathtub, and the threads 93 are threaded into the threads 87. A sealing gasket 101 is interposed between the interior of the bathtub wall and the sealing surface 95 of the mounting flange 90.

In the operation of the bathtub in a recirculating mode, the tub is initially filled with water to the desired level, i.e., to a level at least above the level of the water inlet openings 51 of the tub, and the pump 30 is started by energizing the motor 31 by means of the switch 33. Water from the tub flows through the return line 38 and a passage 43 of the inlet manifold 40 to the intake of the pump, and water is discharged from the pump through the "T" fitting 48 and the flexible hoses 49 into the manifold 50 for flow through the water conduit 52 to each of the nozzle housings 60, 61. The flow of water through the nozzle assembly 80, specifically through the tapered passage 85 of the embossment 84 flows through the nozzle insert 96 into the tub interior. The flow of water through the passage 85 induces the flow of air through the aperture 88 from the air chamber 65 which communicates fully with the air conduit 53, this air entering the air conduit through the control valve 60 and the conduits 59, 58. The nozzle body 81, when water is flowing through the passage 85, acts as a venturi to aspirate the air, with the amount of air being aspirated being controlled by the valve 39.

Thus, it will be seen that the integrally molded conduits 52, 53 of the manifold 50 serve to provide water and aspirated air to each of the nozzle housings 60, 61 for flow through the nozzle assemblies 80 into the tub.

Upon termination of use of the tub, the switch 33 is actuated to stop the motor 31 and the pump 30. Any water in the manifold 50 and the nozzle assemblies 80 will drain into the tub through the nozzles drain openings 89, 99 and out of the tub through the conventional tub drain. Any water remaining in the pump will drain into the interior of the tub through the inlet manifold aperture 47 and the conduit 38.

I claim:

1. Apparatus for supplying water and air to a plurality of spaced discharge locations in a recirculating bathtub, comprising a unitary, molded manifolded having vertically spaced water and air conduits joined by an integral joining portion, said conducts being of a length sufficient to bridge at least two of said discharge locations, said manifold having integral bulbous enlargements spaced at the spacing of said discharge locations and opening onto the water conduit, and said air conduit communicating with said bulbous enlargements through openings formed in said integral joining portion during the molding of said manifold.

2. Apparatus for supplying water and air to a plurality of spaced discharge openings in the side wall of a recirculating bathtub, comprising a pair of integrally formed, spaced conduits joined by an integral joining web, said conduits each being of a length to span at least two of said openings, enlarged housing portions integral with one of said conduits and spaced at the spacing of said tub discharge openings for alignment therewith, means for connecting said one of said conduits with a source of water under pressure, means for connecting the other conduit to a source of air, a nozzle positioned in each of said housing portions to receive water from the one conduit, each of said nozzles projecting from the one conduit for insertion into one of said tub discharge openings, each nozzle having an air chamber, and means establishing communication between said air chambers and said other conduit.

3. A unitary, molded manifold for supplying water and air to a plurality of spaced discharge openings in a recirculating bathtub, comprising a pair of spaced, superimposed, coextensive, integrally molded conduits for water and air, respectively; enlarged, spaced, integrally molded nozzle housings communicating with said waer conduit and spaced at the spacing of said discharge openings; and an integrally molded rib interposed between said conduits to join the conduits into said unitary manifold, said rib preventing communication between said conduits, except at the housing locations where the rib is hollow to interconnect said air conduit and said housings.

4. An apparatus for supplying water and air to a plurality of spaced discharge openings in a recirculating tub, comprising:

(a) a molded, integrally formed manifold having superimposed water and air conduits of a length to span at least two discharge openings and integral means connecting said conduits into a unitary assembly;

(b) a plurality of integrally molded nozzle housings, one for each opening spanned by said manifold, each housing having an internal sealing surace and a flow passage adjacent the sealing surface for receiving water from the water conduit, and each housing having a vertical exterior wall provided with an opening; and (c) a nozzle assembly for each housing, each assembly matingly contacting said sealing surface to project through the opening for insertion through one of the tub discharge openings, each assembly being sealed to the housing vertical wall, and each nozzle assembly having a water passage communicating with the housing flow passage and a vented air passage adjacent the flow passage; and (d) the manifold connecting means isolating the conduits from one another, except at said housing locations where the connecting means connects the air conduit with the air passages of the nozzle assemblies, respectively.

5. In a recirculatory bathtub having side walls each provided with a plurality of aspirating water and air nozzles, a blow molded manifold extending along each side wall exteriorly of the tub to span the plurality of nozzles, said manifold comprising vertically spaced water and air conduits each defined by blow molded walls and a medial rib defined by two walls pinched into face-to-face abutment during blow molding to separate the conduits from one another, a plurality of nozzle housings integrally molded with said water conduit and each adapted to receive one of said nozzles, and the walls of said medial rib being separated at each housing location to establish communication between each of said housings and said air conduit.

6. In a recirculatory bathtub assembly, including a tub having side and end walls, a recirculatory pump, and a plurality of spaced water inlet openings in each of said tub side walls; the improvements comprising:

(a) a unitary, intergrally blow molded air and water manifold having an air conduit and a separate water conduit joined by a common, integral wall isolating said conduits from one another, said common wall being formed to a double thickness by pinching the conduit walls during blow molding, said manifold being of a length to span at least two of said tub inlet openings, and the doulbe thickness common wall having locally separated portions interconnecting said conduits only at the spacing of said tub inlet openings;

(b) means for connecting the outlet of the pump to the water conduit;

(c) means for connecting the air conduit to a source of air;

(d) at least two enlarged blow molded nozzle housings formed integrally with said conduits and located at the spacing of said tub inlet openings, each nozzle housing opening onto said water conduit and one of the separated portions of the common wall, respectively; and (e) a nozzle secured in each of said housings for receiving water from the water conduit and for aspirating air from said air conduit through the adjacent locally separated portion of said common wall.

7. A recirculating bathtub comprising:

(a) a tub having side, end and bottom walls defining an interior tub space and a plurality of water and air entry opening in the side walls;

(b) a water circulation pump having a water outlet and its intake connected to the tub interior;

(c) a molded, unitary manifold extending along each tub side wall exteriorly of the tub to span the entry openings therein, each manifold including a water conduit connected to the pump outlet, and an air conduit connected to a source of air, and a joining rib integral with the conduits and isolating them from one another, and nozzle housings integrally formed with said manifold to register with the tub entry openings, respectively, each housing having a planar free end, an inner opening communicating with the waterr conduit, and a seating face at said inner opening;

(d) a nozzle assembly for each housing, each assembly including a medial flange sealed to the housing end face, an inner projection in said housing engaging said seating face and having a central water passage surrounded by an air chamber, and an outer projection extending through said tub entry portion; and (e) registering openings in said air conduit and said nozzle assembly venting the air chamber to the source of air.

8. A manifold for supplying air and water to each of a plurality of spaced water discharge openings in a recirculating bathtub, the manifold being a molded unitary assembly comprising superimposed, linearly elongated water and air conduits, joined by a web intermediate the conduits, said web being interposed between the conduits to isolate the conduits from one another, and a plurality of nozzle housings, each communicating with the water conduit and projecting laterally therefrom at locations corresponding to the spacing of the tub water discharge openings, said web being locally laterally offset from its position intermediate the conduits into vertical alignment with each housing, each such web offset having an aperture establishing communication between each of said housings and said air conduit.

9. A water and air supply system for a recirculating bathtub having a side wall pierced by a plurality of spaced openings through which a water and air mixture can be supplied to the tub interior, comprising:

(a) a one-piece manifold of a length to span the plurality of tub openings, said manifold comprising a plurality of nozzle housings spaced at the spacing of the tub openings, a water conduit integral with said housings and joining the housings, an air conduit integral with said water conduit yet isolated therefrom, said air conduit being in fluid communication with the interior of each housing;

(b) an aspirating nozzle fixed in each housing to project beyond the manifold for entry through the aligned one of said openings in the tub sidewall, each nozzle having a water flow passage and an air chamber;

(c) means for supplying water under pressure to said water conduit for flow through the water passage of each of said nozzles; and (d) means for supplying air to said air conduit for flow into the air chamber of each of said nozzles.

10. In a recirculatory bathtub having side and end walls and adapted to contain a body of water, a circulation pump having its intake vented to the tub interior, and a plurality of aspirating water and air nozzles in the tube side walls for discharging admixed water and air into the tub interior, the improvements of a unitary manifold comprising integrally formed water and air conduits, each of circular cross-sectional configuration and isolated from one another by an intermediate wall, and integrally formed enlarged nozzle housings connecting the conduits to said nozzles, the water conduit joining the discharge of said pump to at least two of said housings and the associated nozzles, and the air conduit being vented to a source of air and communicating with said housings and the associated nozzles through openings formed in said intermediate wall.

11. A manifold for supplying air and water to each of a plurality of spaced water discharge nozzles in a recirculating bathtub, the manifold being a unitary assembly comprising superimposed, integrally formed, linearly elongated water and air conduits, said conduits being isolated from one another, and a plurality of nozzle housings integrally formed with said conduits, each nozzle housing communicating with both conduits and projecting laterally therefrom at locations corresponding to the spacing of the tub water discharge nozzles.

12. In a recirculating bathtub having a plurality of water inlet openings and a pump for supplying water under pressure, the improvements comprising means for supplying water from the pump to each of said water inlet openings including water conduits and a nozzle located at each of said inlet openings,, the water conduits sloping downwardly from the pump discharge to said nozzles, and said nozzles having drain openings to drain water from the conduits into the tub upon stopping of the pump, a recirculation conduit for supplying water from the tub to the pump, and a pump inlet manifold including an upwardly inclined water passage from the recirculation conduit to the pump intake and a lower drain passage from the pump housing to the recirculation conduit for draining the pump housing into the recirculation conduit when the pump is stopped.

13. In a recirculating bathtub having a water circulation pump and a plurality of bathtub openings for the introduction of air and water into the tub, the improvements of means for supply water and air to a plurality of said openings comprising an elongated water conduit having integral bulbous nozzle housings receiving water from the water conduit and spaced at the spacings of at least two of the tub openings, an elongated air conduit integrally formed with said water conduit and vertically offset therefrom through an integrally formed intermediate joining portion isolating the conduits from one another, each nozzle housing having a vertical passage interrupting said joining portion to vent the housing to the air conduit, and nozzle assemblies secured in said nozzle housings, respectively, to project laterally from the water conduit housings for entry into the tub openings, and said nozzle assemblies each receiving water from the nozzle housings and receiving air from said vertical passage interrupting said joining portion.

* * * * *